US006420941B2

(12) United States Patent
Okada et al.

(10) Patent No.: US 6,420,941 B2
(45) **Date of Patent: *Jul. 16, 2002**

(54) NONRECIPROCAL CIRCUIT DEVICE

(75) Inventors: Takekazu Okada, Ishikawa-ken; Toshihiro Makino, Matto; Akihito Masuda, Kanazawa; Takashi Kawanami, Ishikawa-ken, all of (JP)

(73) Assignee: Murata Manufacturing Co., Ltd. (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/153,687

(22) Filed: Sep. 15, 1998

(30) Foreign Application Priority Data

Sep. 17, 1997 (JP) ..... 9-252205
Sep. 17, 1997 (JP) ..... 9-252207

(51) Int. Cl.[7] ..... H01P 1/32; H01P 1/36; H01P 1/383

(52) U.S. Cl. ..... 333/1.1; 333/24.2

(58) Field of Search ..... 333/1.1, 24.2

(56) References Cited

U.S. PATENT DOCUMENTS 5,450,045 A 9/1995 Miura et al. ..... 333/1.1
5,923,224 A * 7/1999 Makino et al. ..... 333/1.1
5,945,887 A * 8/1999 Makino et al. ..... 333/1.1

FOREIGN PATENT DOCUMENTS

EP 0618636 5/1994
EP 0776060 5/1997
JP 5-315814 * 11/1993 ..... 333/24.2
JP 6-252610 * 9/1994 ..... 333/24.2
JP 6343005 12/1994
JP 9213523 8/1997
KR 1994-23070 10/1994

OTHER PUBLICATIONS

Patent Abstracts of Japan, JP09 213523 A, Murata Manufacturing Co., Ltd., Aug. 15, 1997.

Korean Examination Report dated Dec. 27, 2001, along with the English Translation.

* cited by examiner

*Primary Examiner*—Robert Pascal
*Assistant Examiner*—Stephen E. Jones
(74) *Attorney, Agent, or Firm*—Ostrolenk, Faber, Gerb & Soffen, LLP

(57) ABSTRACT

A nonreciprocal circuit device requires less layout space when single-board capacitors are used, and meets demands for a smaller and lighter configuration. An isolator (nonreciprocal circuit device) comprises a ferrite, a permanent magnet applying a direct current magnetic field to the ferrite, a plurality of central electrodes respectively having ports disposed on the ferrite and a single-based matching capacitor with capacitor electrodes formed on both surfaces of a dielectric substrate such that the capacitor electrodes are opposed to each other and sandwich the dielectric substrate. In various embodiments, the permanent magnet and/or; the ferrite has a square shape and the capacitor electrodes of the matching capacitors are arranged at an angle of 60 to 90 degrees with respect a mounting surface and the matching capacitors are disposed so as to surround the sides of the ferrite.

22 Claims, 10 Drawing Sheets

NONRECIPROCAL CIRCUIT DEVICE

BACKGROUND OF THE INVENTION

1. Field of the Invention

The present invention relates to a nonreciprocal circuit device for use in the microwave band such as, for instance, an isolator or a circulator.

2. Description of the Related Art

Generally, a lumped constant isolator, used in mobile communication equipment such as mobile telephones, has a function which allows signals to pass only in the transmission direction while preventing transmission in the reverse direction. Furthermore, given the recent usage of mobile communication equipment, there are growing demands for smaller, lighter and less expensive devices. In the case of the isolator, there are similar demands for a smaller, lighter and cheaper device.

Conventionally, as shown in FIG. 6, this type of lumped constant isolator has a structure comprising top and bottom yokes 50 and 51 which contain, in sequence from the top, a permanent magnet 52, a central electrode body 53, a matching circuit board 54 and a ground board 55. The central electrode body 53 comprises three central electrodes 57, which intersect in an electrically insulated state on a disc-shaped ferrite 56.

Furthermore, the matching circuit board 54 comprises a rectangular thin-board dielectric substrate 54*a*, having a round hole 54*b*, which the central electrode body 53 is inserted into, formed in the center thereof; and capacitor electrodes 58 . . . , which input/output ports P1–P3 of the central electrodes 57 are connected to, formed around the round hole 54*b* in the dielectric substrate 54*a*. Further, an end resistance film 59 is connected to the port P3.

However, since the above conventional matching circuit board 54 requires forming the round holes 54*b* in the thin-board dielectric substrate 54*a* and patterning the central electrodes 57, there is a problem of complex processing during manufacture and assembly, increasing costs.

A further problem is that the parts other than the capacitor electrodes 58 unnecessarily increase the area and weight of the conventional dielectric substrate 54*a*, making it more difficult to produce a smaller and lighter device. In this connection, recently there is a demand for reducing the weight of isolators to the milligram level.

Yet another problem of the conventional matching circuit board 54 is that, since the capacitor electrodes 58 are formed on a dielectric substrate 54*a* having high permittivity, adjacent capacitor electrodes 58 are prone to electrostatic coupling Cp, which is damaging to the attenuation properties of the isolator outside the band.

In another conventional isolator, a single plate capacitor, comprising opposing electrodes provided on either side of a dielectric substrate so as to completely cover the surfaces thereof, is used as each of the the capacitors in lieu of the matching circuit board.

This single plate capacitor can be manufactured by forming electrodes on the two main surfaces of a motherboard, which comprises a large flat board, and cutting the motherboard to predetermined dimensions. Such a single plate capacitor can therefore be mass-produced. Consequently, processing and handling are easier than when round holes and multiple capacitors are provided to a conventional dielectric substrate, and cost can be reduced. In addition, since electrodes are formed over the entire faces of the substrate, unnecessary increase of area and weight can be eliminated, thereby enabling the isolator to be made smaller and lighter by a proportionate amount. Moreover, since the capacitors are provided separately, it is possible to prevent electrostatic coupling between them and thereby avoid deterioration of attenuation properties outside the band.

FIG. 4 and FIG. 5 show a example of an isolator using a single plate capacitor and are not the prior art. Like members corresponding to those in FIG. 6 are designated by like reference characters. This isolator comprises a resin terminal block 60, having a round hole 61 provided in the base wall 60*a* thereof, the central electrode body 53 being inserted into the round hole 61; rectangular single plate capacitors C1–C3, provided on the periphery of the round hole 61 so as to surround the central electrode body 53; and a single plate resistor R.

As shown in FIG. 5, when the single plate capacitors C1–C3 are provided around the central electrode body 53, unwanted vacant spaces 62 are created therebetween. This is an obstacle to making the device smaller and lighter, and the demand mentioned above cannot be fulfilled.

Moreover, although the above single plate capacitors C1–C3 enable the isolator to be made smaller and lighter than the conventional device, a considerable amount of space is nevertheless taken up with respect to the whole of the isolator since the electrode area is determined by the required matching capacitance. This is a further obstacle to making the device small and light.

In order to reduce the size of the capacitors themselves, countermeasures such as the following have been considered and implemented: (1) use a high-permittivity material as the dielectric substrate; (2) further reduce the thickness of the dielectric substrate; (3) use laminated-chip capacitors.

However, in the case of (1), material having maximum permittivity of 100–120 is already being used. Material of even higher permittivity has unsuitable temperature characteristics and high-frequency characteristics decline, thus loss at the microwave band becomes considerably large. For these reasons, such material can not be employed.

Furthermore, in the case of (2), a substrate of approximate thickness 0.2 mm is generally used. Reducing the thickness even further would cause an extreme reduction in the strength of the substrate, worsening yield and consequently lowering productivity as well as lowering the reliability of product quality.

Finally, in the case of (3), laminated capacitors generally have Q of 20–100 at the microwave band. This is much lower than the single plate capacitor using dielectric material for high-frequency, which has Q of more than 200, causing further loss of the characteristics of isolator. Furthermore, although the conventional laminated capacitor has relatively small top area S of approximately 0.5 $mm^2$, it is approximately 0.5 mm tall, and hence has volume V of 0.25 $mm^3$. By contrast, the single plate capacitor has S of 1.2 $mm^2$ and V of approximately 0.24 $mm^3$. Therefore, the size reduction achieved when using a laminated capacitor is hardly significant.

SUMMARY OF THE INVENTION

The present invention has been realized after consideration of the above points and aims to provide a nonreciprocal circuit device capable of reducing layout space when using single plate capacitors, and meeting demands for a smaller and lighter device.

The nonreciprocal circuit device of the present invention comprises a plurality of central electrodes provided to a ferrite, to which a permanent magnet applies a direct current magnetic field, ports of the central electrodes being connected to capacitors for matching; wherein the capacitors for matching comprise single plate capacitors, formed by providing electrodes on both main surfaces of a dielectric substrate such that the electrodes completely cover the main surfaces and oppose each other with the dielectric substrate disposed therebetween; and electrode surfaces of the single plate capacitors are provided at an angle of 60–90 degrees to a mounting surface.

A second aspect of the present invention comprises the nonreciprocal circuit device according to the first aspect, wherein at least a portion of electrodes at the cold (ground) ends of the single plate capacitors face the outside of the device.

A third aspect of the present invention comprises the nonreciprocal circuit device according to the first aspect, wherein at least a portion of electrodes at the hot (port) ends of the single plate capacitors face the outside of the device.

A fourth aspect of the present invention comprises the nonreciprocal circuit device according to any one of the first to third aspects, wherein the ferrite is square when viewed from the top and the single plate capacitors are provided so as to enclose the sides of the ferrite.

A fifth aspect of the present invention comprises the nonreciprocal circuit device according to any one of the first to fourth aspects, wherein the permanent magnet is square when viewed from the top.

A sixth aspect of the present invention comprises a nonreciprocal circuit element comprising a ferrite, a permanent magnet applying a direct current magnetic field to the ferrite, a plurality of central electrodes respectively having ports disposed on the ferrite and a matching capacitor with capacitor electrodes formed on both surfaces of a dielectric substrate such that the capacitor electrodes are opposed to each other and sandwich the dielectric substrate, wherein the ferrite has a square shape and the capacitor electrodes of the matching capacitors are inclined at an angle of 60 to 90 degrees toward a mounting surface and the matching capacitors are disposed so as to surround sides of the ferrite.

A seventh aspect of the nonreciprocal circuit device of the present invention comprises a plurality of central electrodes provided on a ferrite, to which a permanent magnet applies a direct current magnetic field, ports of the central electrodes being connected to capacitors for matching; wherein the capacitors for matching are single plate capacitors, comprising electrodes provided on both main surfaces of a dielectric substrate such that electrodes completely cover the main surfaces and oppose each other with the dielectric substrate disposed therebetween; the ferrite is square when viewed from the top, and the single plate capacitors are provided so as to enclose the ferrite.

A eighth aspect of the present invention comprises the nonreciprocal circuit device according to the seventh aspect, wherein the single plate capacitors are rectangular and extend along the sides of the ferrite.

A ninth aspect of the present invention comprises the nonreciprocal circuit device according to either of the seventh and eighth aspects, wherein the permanent magnet is square.

DESCRIPTION OF THE PREFERRED EMBODIMENTS

There will be detailed below the preferred embodiments of the present invention with reference to the accompanying drawings.

Figure 1:
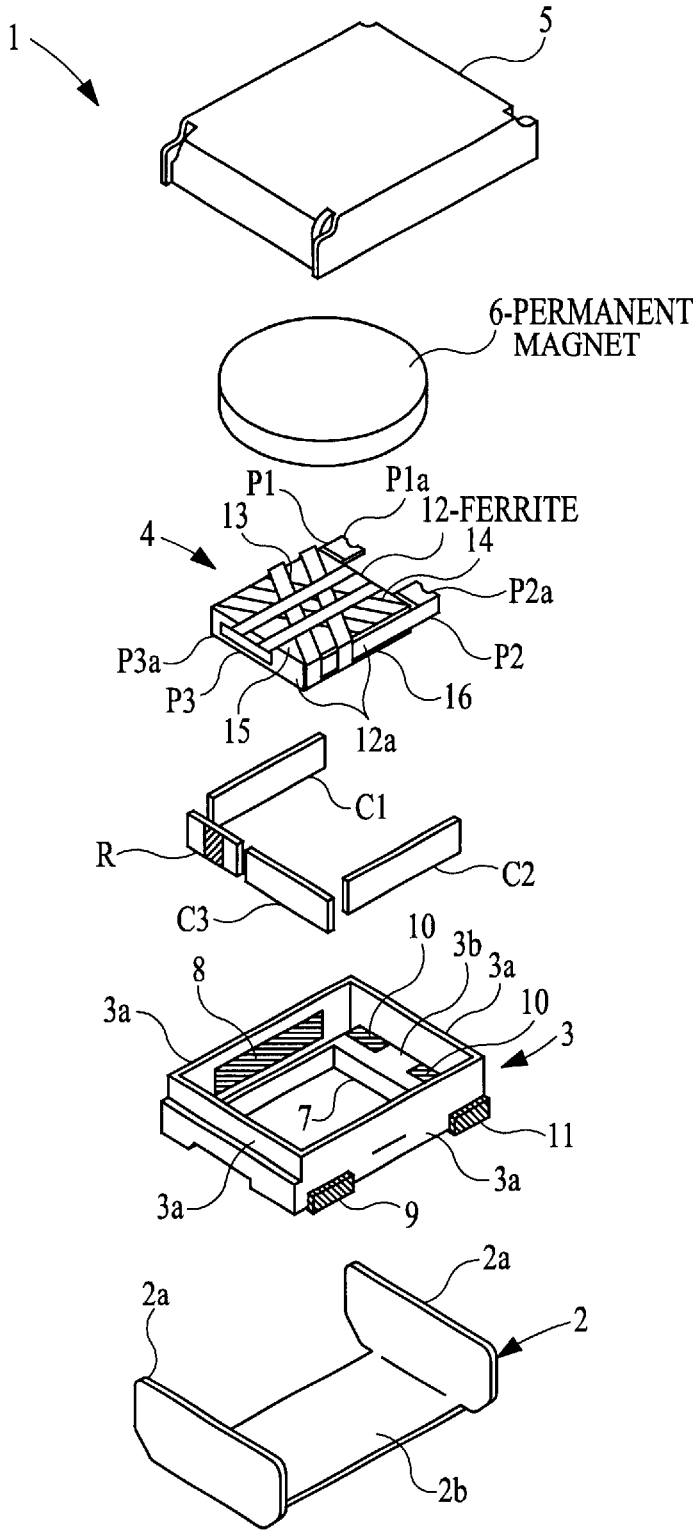
FIG. 1 is an exploded perspective view explaining a lumped constant isolator according to an exemplary embodiment of the present invention.
Figure 2:
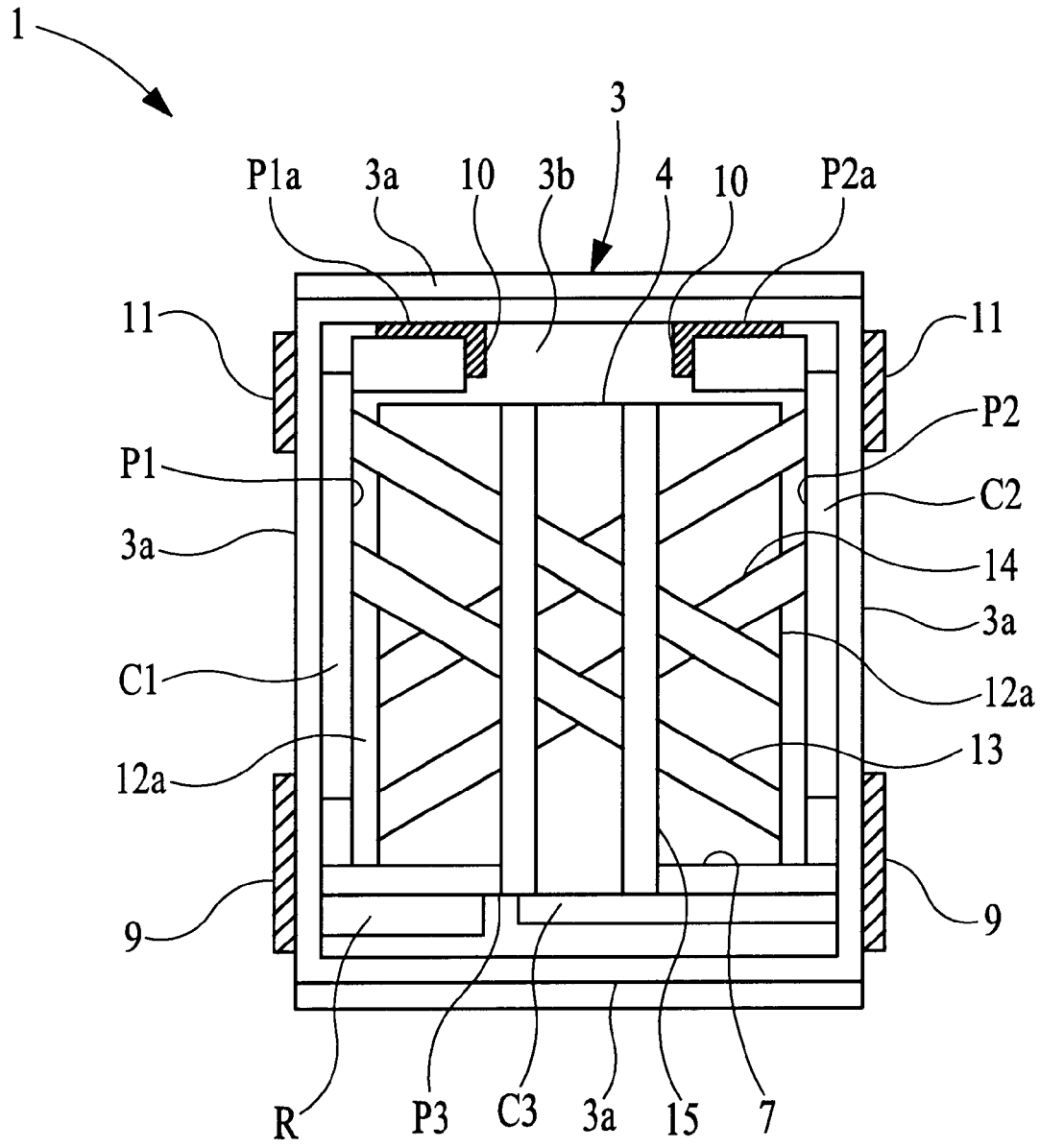
FIG. 2 is a top view of the above isolator with the top yoke and the permanent magnet removed.

FIG. 1 and FIG. 2 are diagrams explaining a lumped constant isolator according to a first embodiment of the present invention, FIG. 1 showing an exploded perspective view of the isolator, and FIG. 2, a top view of the isolator when the top yoke and the permanent magnet are removed.

The lumped constant isolator 1 of the present embodiment comprises a resin terminal substrate 3 provided on a magnetic metallic bottom yoke 2, having right-side and left-side walls 2*a* and 2*a* and a base wall 2*b*. In addition, a central electrode assemblage 4 is provided on the terminal substrate 3, and a box-shaped top yoke 5, comprising the same magnetic metal as the bottom yoke 2, is provided on top, thereby forming a magnetic closed circuit. Furthermore, a disc-shaped permanent magnet 6, which applies a direct current magnetic field to the central electrode assemblage 4, is affixed to the inner surface of the top yoke 5.

The above isolator 1 is a parallelepiped with outer dimensions: top of less than 7.5×7.5 mm; height of less than 2.5 mm. The isolator 1 is surface-mounted on the base wall 2*b* and connected to conductive lines on a circuit board which is not shown in the diagram.

The central electrode assemblage 4 comprises three central electrodes 13–15, which intersect alternately every 120 degrees, provided in an electrically insulated state on the upper surface of a microwave ferrite 12, which is square when viewed from above. Input/output ports P1–P3 connected to one terminal side of each of the central electrodes 13–15 project outwards, and a shield 16, which is shared by the other terminal sides of the central electrodes 13–15, abuts to the lower surface of the ferrite 12. This shield 16 is connected to the base wall 2*b* of the bottom yoke 2.

The central electrodes 13–15 are arranged parallel towards the mounting surface. The input/output ports P1–P3 of the central electrodes 13–15 are bent downwards at right angles towards the mounting surface. Furthermore, tips P1*a* and P2*a* of two of the input/output ports P1 and P2 are parallel with the mounting surface.

The terminal substrate 3 comprises a base wall 3*b*, having a square hole 7 provided therein, secured in a single body to rectangular side walls 3*a*. The ferrite 12 is inserted into the square hole 7 and secured in position.

Thus, the ground electrodes 8, provided on the inner surfaces of the left, right and lower side walls 3*a*, are connected to the ground terminals 9 and 9 provided on the outer surfaces of the left and right side walls 3*a*. Furthermore, input/output ports 10 and 10 are provided at both ends of the upper edge of the base wall 3*b*. These ports 10 are connected to input/output terminals 11 and 11 which are provided on the outer surfaces of the left and right side walls 3*a*. The input/output terminals 11 and the ground terminals 9 are connected to conductive lines on a circuit board which is not depicted in the diagram.

Single plate capacitors C1–C3, which are provided on the inner surfaces of the left, right and lower side walls 3*a* of the terminal substrate 3, fit along the sides 12*a* of the ferrite 12 so as to enclose the ferrite 12. Furthermore, an end resistance R is provided on the lower side wall 3*a* in parallel with the single plate capacitor C3. The resistance R is connected to the ground terminal 9.

Each of the single plate capacitors C1–C3 is formed by providing capacitor electrodes on both main surfaces of a rectangular dielectric substrate in such a manner that the capacitor electrodes completely cover the main faces and oppose each other with the dielectric substrate disposed therebetween. Alternatively, the single plate capacitors C1–C3 can be formed by patterning capacitor electrodes on a motherboard, comprising a large flat board, and cutting the motherboard into predetermined shapes.

Then, the single plate capacitors C1–C3 are provided at an angle of 90 degrees, that is, perpendicular to the mounting surface. Furthermore, the electrodes at the cold ends of the single plate capacitors C1–C3 are connected to the ground electrodes. 8, and the electrodes at the hot ends are connected to the input/output ports P1–P3. Consequently, the cold end electrode sides of the single plate capacitors C1–C3 are facing the outside of the isolator since the ground electrode 8 is connected to the ground terminal 9.

Here the cold end of a capacitor means the electrode of the capacitor that is connected to the ground electrode. The hot end means a side of capacitor electrode connected to the port.

Furthermore, the tips P1*a* and P2*a* of the input/output ports P1 and P2 connect to the ports 10. The tip P3*a* of the remaining port P3 is connected to the end resistance R. As above, the end resistance R is provided at an angle of 90 degrees to the mounting surface.

Now referring to FIGS. 7 and 8, the second embodiment of the present invention will be explained in detail. Same numerals are assigned to similar members of the first embodiment and the detailed explanation thereof is omitted.

Figure 7:
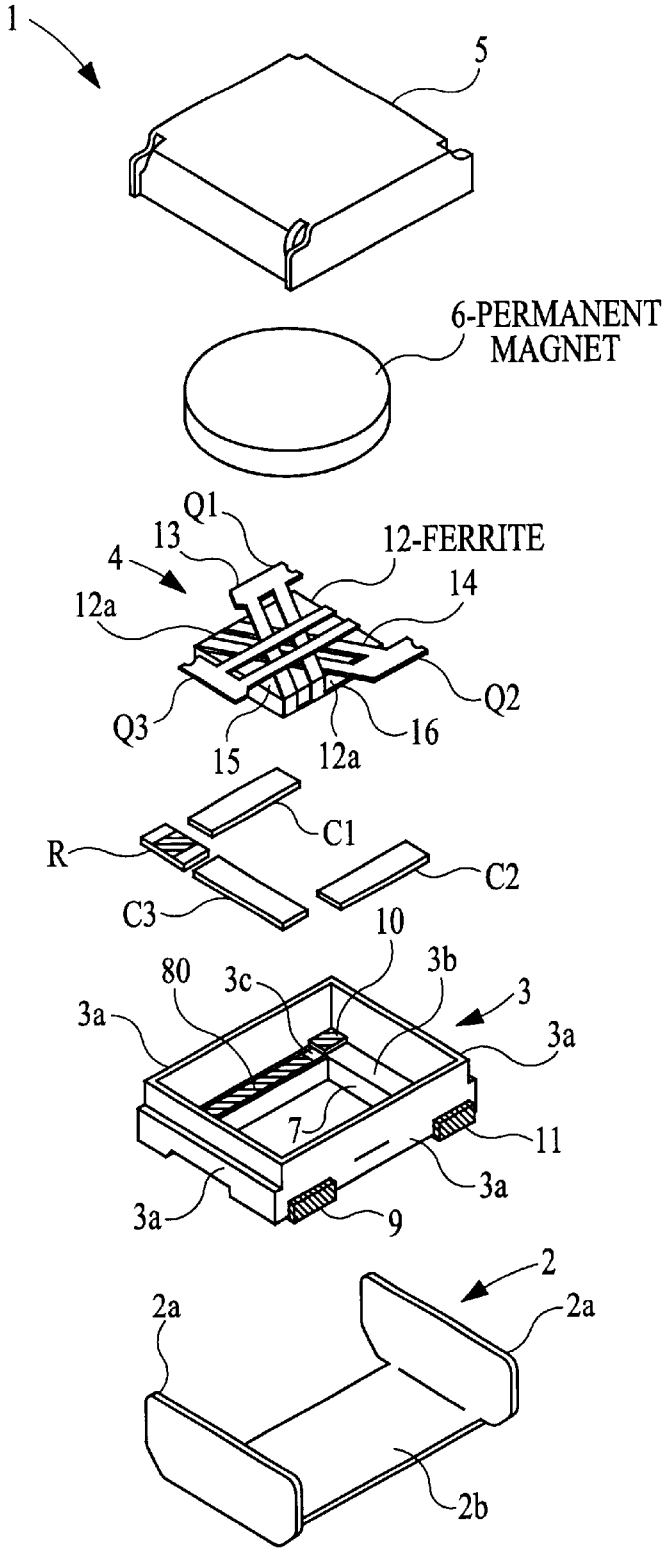
FIG. 7 is an exploded perspective view explaining an lumped constant isolator according to another exemplary embodiment of the present invention.
Figure 8:
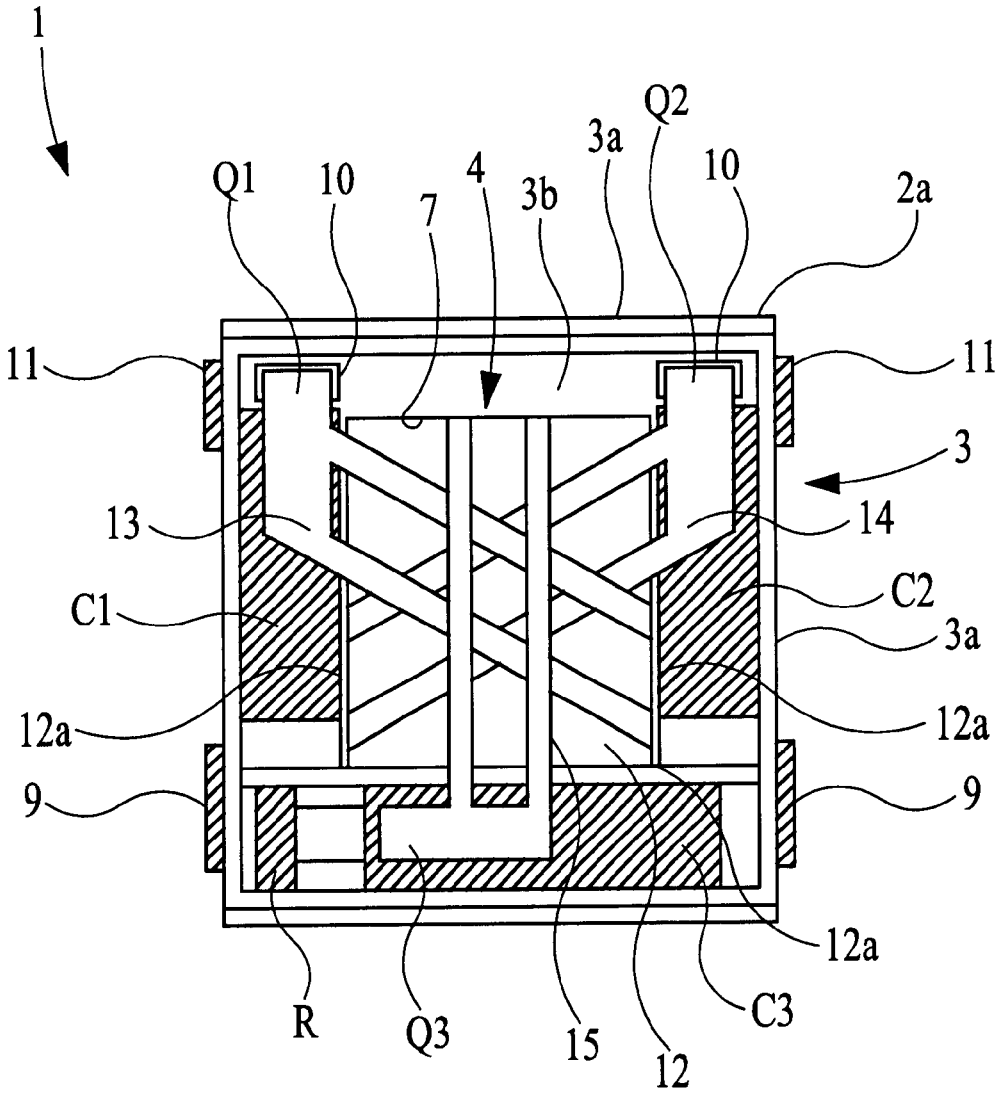
FIG. 8 is a top view of the above isolator with the top yoke and the permanent magnet removed.

As shown in FIG. 7, the terminal substrate 3 comprises a base wall 3*b*, having a square hole 7 provided in the center thereof, secured in a single body to rectangular side walls 3*a*. Recesses 3*c* for positioning capacitors are provided in the left, right and lower edges of the square hole 7 in the base wall 3*b*, and a ground electrode 80 is provided on the bottom surface of each recess 3*c*. These ground electrodes 80 are connected to ground terminals 9 and 9 provided on the outer surfaces of the left and right side walls 3*a*.

Furthermore, input/output ports 10 and 10 are provided at the left and right upper ends of the base wall 3*b*. These ports 10 are connected to input/output terminals 11 and 11 which are provided on the outer surfaces of the left and right side walls 3*a*. The input/output terminals 11 and the ground terminals 9 are surface-mounted on a circuit board which is not depicted in the diagram.

Single plate capacitors for matching C1–C3 are accommodated in the positioning recesses 3*c*. The lower surfaces of the electrodes at the cold ends sides of the single plate capacitors C1–C3 are connected to the ground electrodes 80. Furthermore, an end resistance R is provided in parallel with the single plate capacitor C3 inside the positioning recess 3*c*. This end resistance R is connected to the ground terminal 9.

The input/output ports Q1–Q3 of the central electrodes 13–15 are connected to the upper surface electrodes at the hot ends, of the single plate capacitors C1–C3. Tips of two of the input/output ports Q1 and Q2 connect to the input/output ports 10, and the tip of the remaining Q3 is connected to the end resistance R.

Furthermore, the ferrite 12 is square and is inserted in the square hole 7 provided in the terminal substrate 3. Consequently, the single plate capacitors C1–C3 enclose the sides 12*a* of the ferrite 12 while also extending along these sides 12*a*.

The nonreciprocal circuit device of the present invention includes that a ferrite has a circular shape and electrode surfaces of the single plate capacitors are disposed at an angle of 60 to 90 degrees to a mounting surface, although only a 90 degree angle is shown in some of the drawings.

Additionally the shape of the ferrite is not limited to being a square. For example, a circular shape as mentioned above or any other shapes may be employed.

Figure 3:
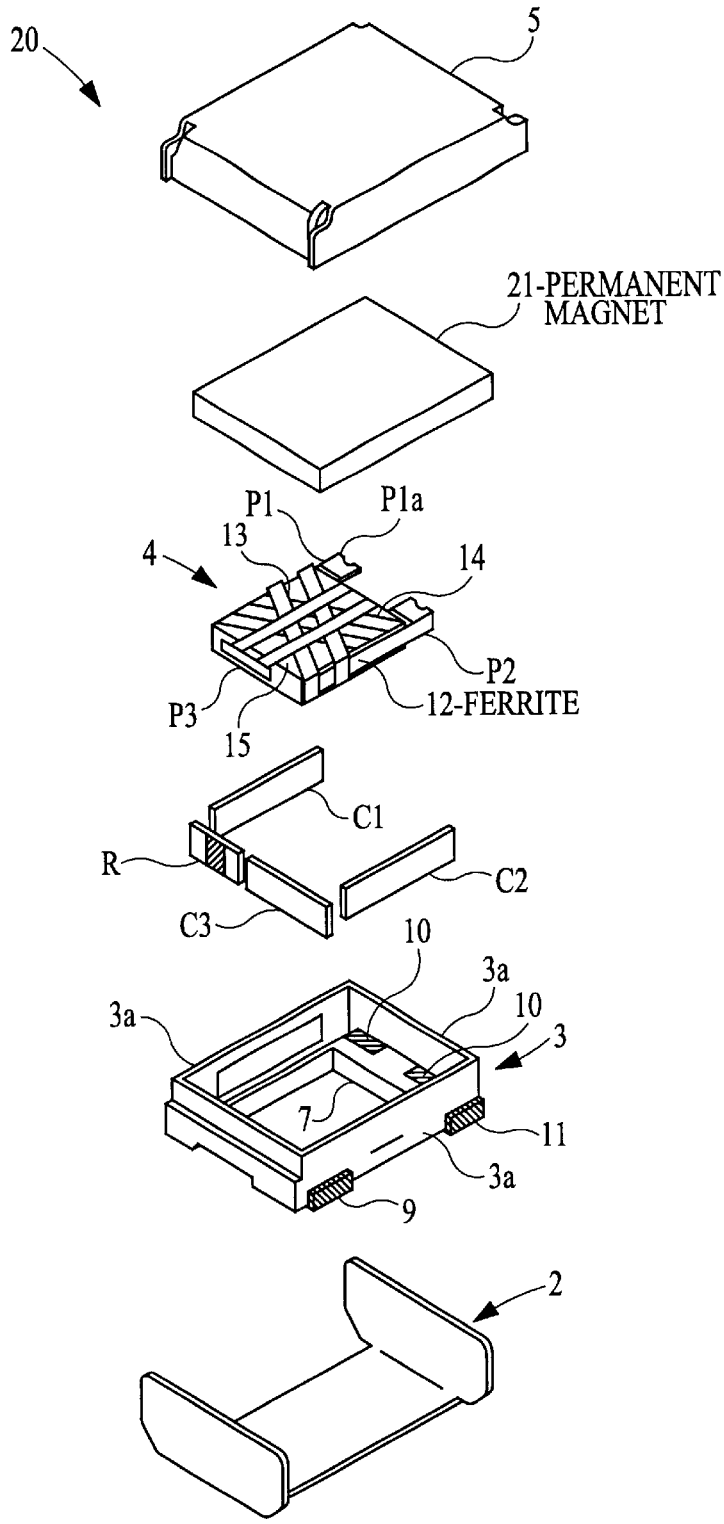
FIG. 3 is an exploded perspective view showing an isolator in another exemplary embodiment according to the present invention.
Figure 4:
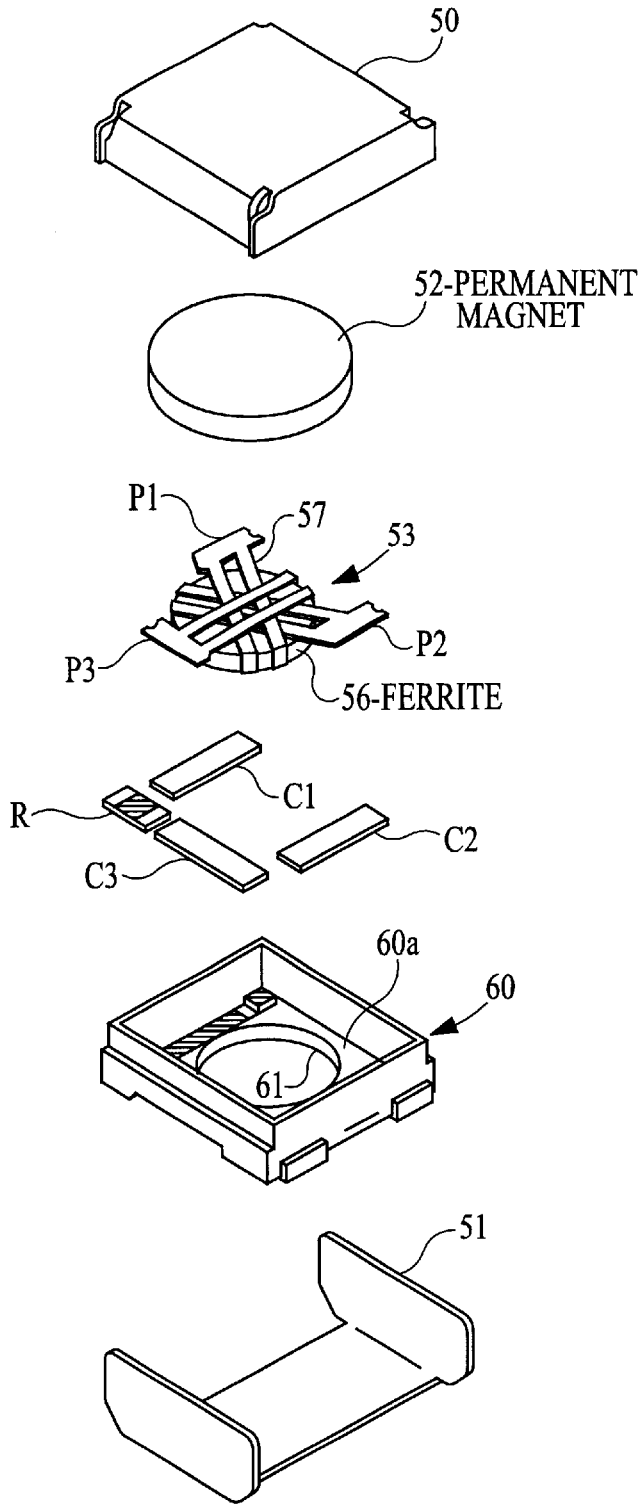
FIG. 4 is an exploded perspective view of an example of an isolator using a single plate capacitor.
Figure 5:
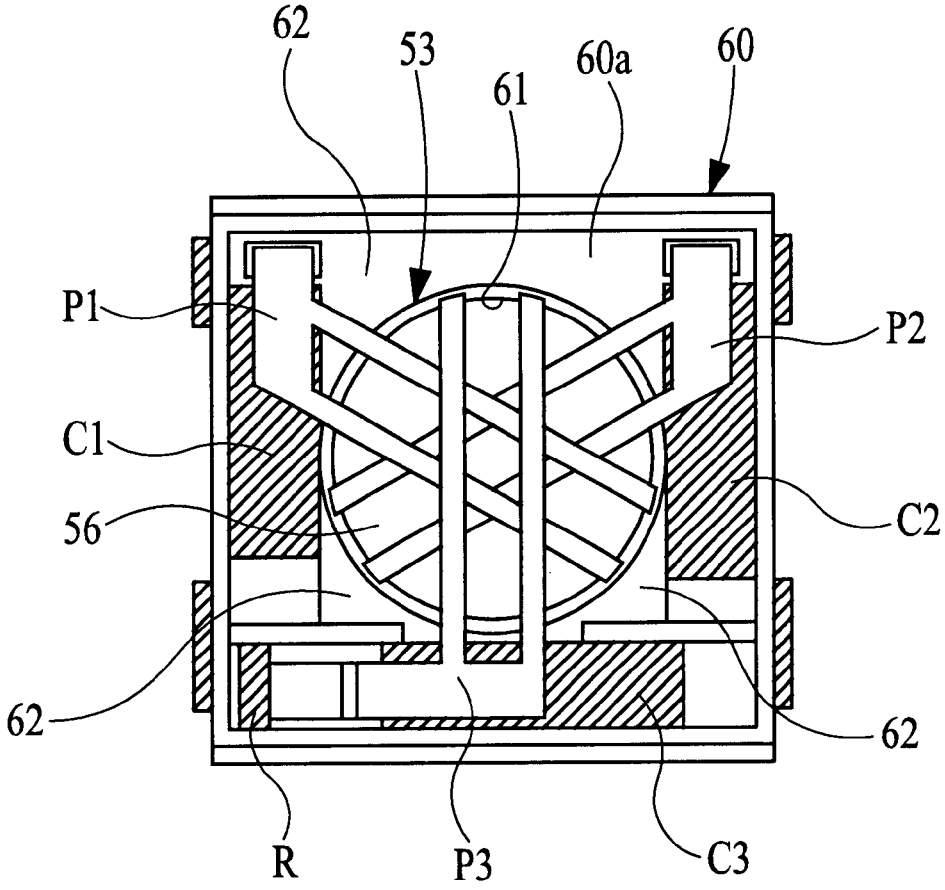
FIG. 5 is a top view of the isolator shown in FIG. 4.
Figure 6:
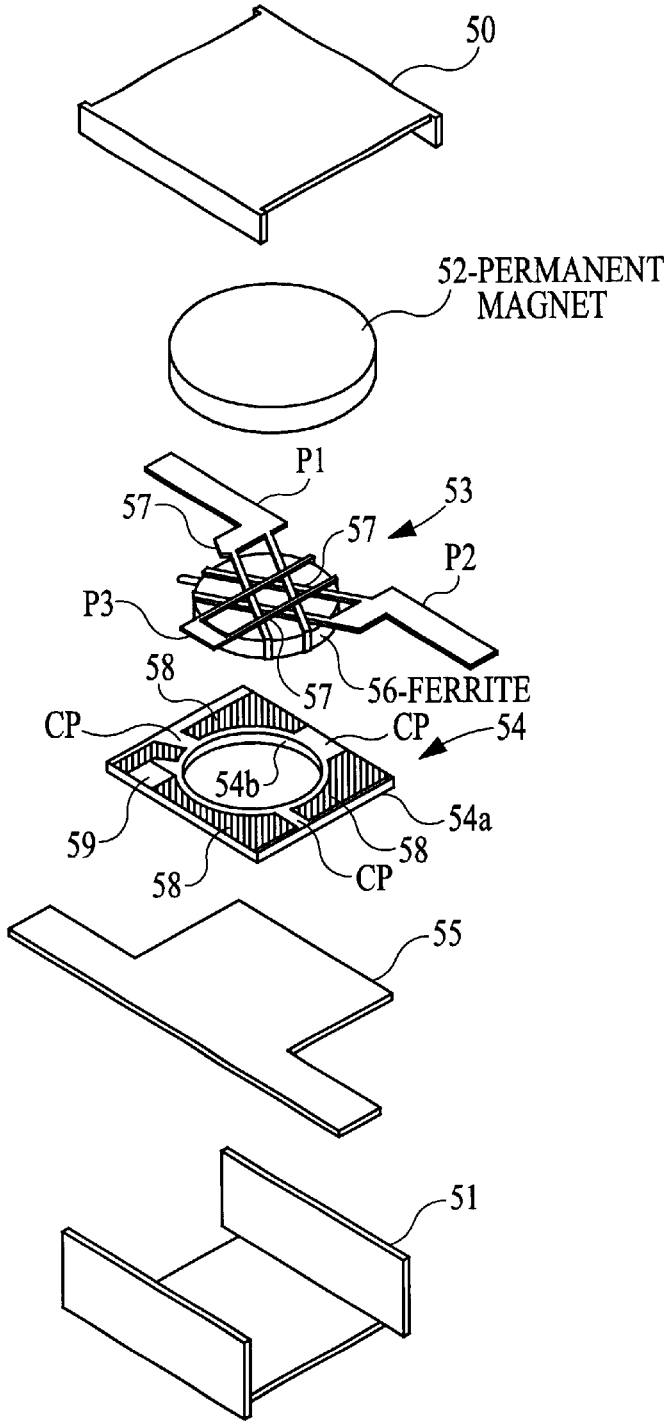
FIG. 6 PRIOR ART
FIG. 6 is an exploded perspective view of a conventional isolator in general use.

FIG. 3 is a diagram illustrating a lumped constant isolator according to the third embodiment of the present invention. In the diagram, like members are designated by like reference characters.

The configuration of the lumped constant isolator 20 of the present embodiment is basically the same as the first embodiment already described, comprising single plate capacitors C1–C3 provided at an angle of 90 degrees to the mounting surface. However, in the present embodiment, a square permanent magnet 21 applies the direct current magnetic field to the ferrite 12.

Figure 9:
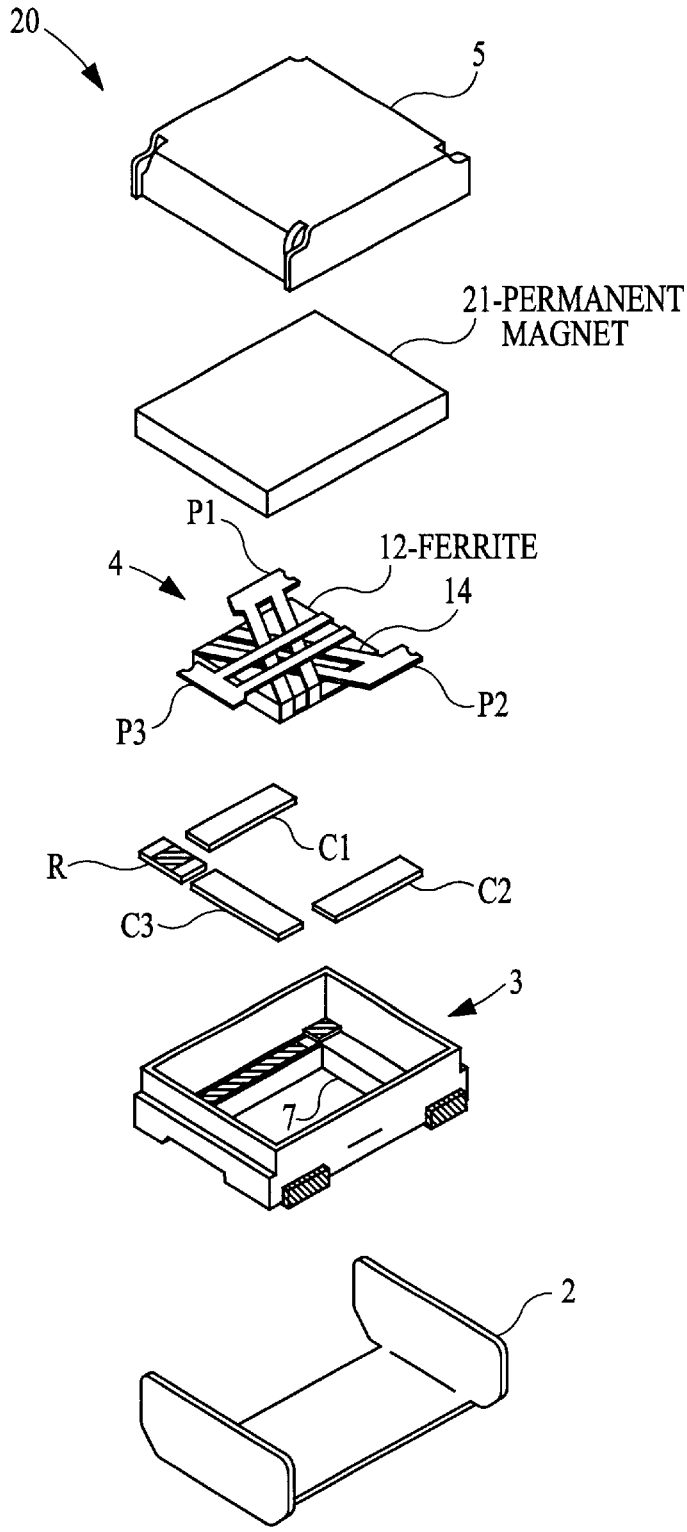
FIG. 9 is an exploded perspective view of an isolator according to another exemplary embodiment of the present invention.

FIG. 9 is a diagram illustrating a lumped constant isolator according to the fourth embodiment of the present invention. In the diagram, like members to those depicted in FIG. 1 are designated by like reference characters.

The configuration of the lumped constant isolator 20 of the present embodiment is basically the same as the second embodiment already described, comprising single plate capacitors C1–C3 extending along the sides of the ferrite 12, which is square. However, in the present embodiment, a permanent magnet 21, which applies direct current magnetic field to the ferrite 12, is square when viewed from the top.

According to the third and fourth embodiments, the ferrite 12 and the permanent magnet 21 are both square in shape. Consequently, an optimum magnetic field can be applied to the ferrite 12, improving electrical characteristics. Furthermore, since the permanent magnet 21 is square, it can easily be manufactured by calcinating a cluster of magnetic blocks and cutting out pieces of predetermined thickness, thereby lowering costs in the same way as above.

Further, the above embodiments described an example of a lumped constant isolator, but the present invention can also be applied to a circulator, in addition to other nonreciprocal circuit devices used in high-frequency parts.

Next, the effects of the present embodiment will be explained.

According to the lumped constant isolator 1 of the present embodiment, since the single plate capacitors C1–C3 are provided at an angle of 90 degrees to the mounting surface, the area occupied by the single plate capacitors C1–C3 when viewed from the top can be greatly reduced. Therefore, the isolator can be made smaller by a proportionate amount, meeting the demand mentioned above. By providing the single plate capacitors C1–C3 in a perpendicular position, the top area of the terminal substrate 3 can be reduced and the weight can be reduced by a proportionate amount.

It may be envisaged that providing the single plate capacitors C1–C3 in a perpendicular position will increase the height of the isolator. However, the height of the single plate capacitors C1–C3 can be accommodated enough by the thickness of the ferrite 12 and the gap between the ferrite 12 and the permanent magnet 6 without increasing the height of the isolator. The above gap is generally provided in order to prevent the permanent magnet from being so close to the high-frequency circuits that its electrical characteristics deteriorate. Therefore the thickness and the gap might be employed as play for accommodating the height of the single plate capacitors.

In the present embodiment, since the cold end electrodes of the single plate capacitors C1–C3 face the outside of the isolator and the hot end electrodes face the inside, it is possible to prevent electromagnetic waves radiating from the hot ends from leaking to the outside. As a consequence, when the device is used in mobile communications equipment, unnecessary radiation inside the equipment can be reduced, contributing to stable operation.

According to the present embodiment, the single plate capacitors C1–C3 are provided so as to enclose the sides 12*a* of the ferrite 12, which is square. As a result, the area around the ferrite 12 can be utilized more efficiently without changing the actual area and capacity of the ferrite 12, or the length and width of the central electrodes. Therefore, vacant space between the ferrite 12 and the single plate capacitors C1–C3 can be eliminated, further contributing to making the isolator smaller and lighter.

Furthermore, since the ferrite 12 is square, it can easily be manufactured by calcinating a cluster of ferrite blocks and cutting out pieces of predetermined thickness, thereby lowering costs. In this connection, when manufacturing the conventional disc-shaped ferrite, there is a problem of high cost since ferrites must be formed individually from metal and then calcinated separately.

In the embodiment detailed above, the cold end electrodes of the single plate capacitors C1–C3 face the outside of the isolator. However, according to the present invention, the hot end electrodes may face the outside. When the hot end electrodes face the outside, it is easier to send and receive signals to/from the outside.

Furthermore, the above embodiment described an example in which the single plate capacitors C1–C3 were provided perpendicular to the mounting surface, but alternatively, although not shown, may be provided diagonal thereto. In such a case, the projected area when viewed from the top can be reduced, enabling the isolator to be made smaller.

According to the lumped constant isolator 1 of the present embodiment, since the single plate capacitors C1–C3 are provided so as to enclose the sides 12*a* of the ferrite 12 which is square, the area around the ferrite 12 can be utilized more efficiently without changing the actual area and volume (capacity) of the ferrite, or the length and width of the central electrodes 13–15. In this case, there is almost no change in the electrical characteristics of the device as compared with a case where a conventional medium size ferrite is used. Consequently, vacant space between the ferrite 12 and the single plate capacitors C1–C3 can be eliminated, whereby the total size can be reduced and made lighter by a proportionate amount, fulfilling the demand mentioned above.

Furthermore, since the single plate capacitors C1–C3 are rectangular in shape and extend along the sides 12*a* of the ferrite 12, the area can be utilized more efficiently and size and weight can be further reduced.

Since the present embodiment uses the single plate capacitors C1–C3, manufacture is easy and mass-production is possible, as described above. Therefore, product cost can be reduced. Furthermore, processing and assembling are easier than when round holes and capacitor electrodes are formed on a thin flat board as in the conventional case. As a result, damage such as breakage can be avoided and reliability of product quality can be improved.

Figure 10:
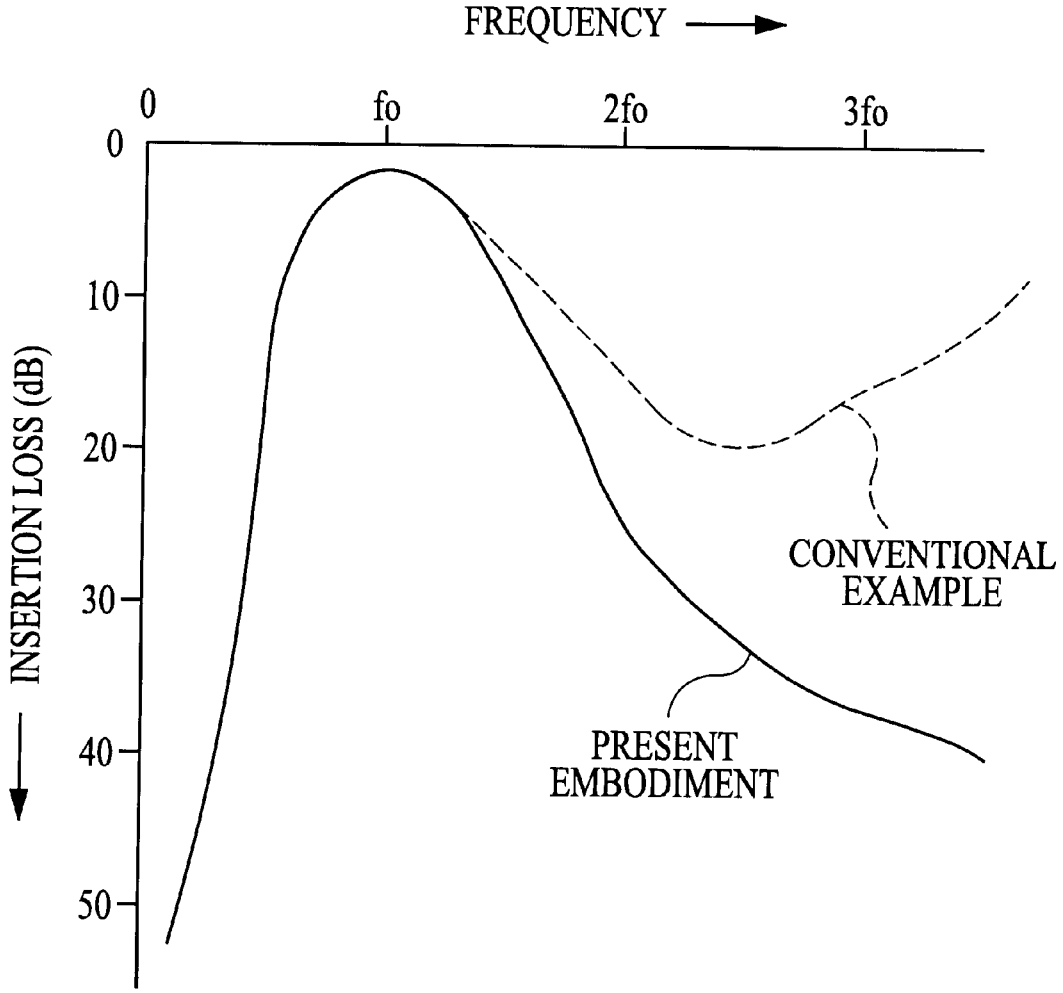
FIG. 10 is a diagram showing attenuation characteristics of the above isolator outside the band.

Furthermore, it is possible to prevent deterioration of attenuation characteristics of the isolator outside the band by reducing electrostatic coupling between the single plate capacitors C1–C3. That is, as shown in FIG. 10, when capacitor electrodes are formed on a conventional dielectric substrate, attenuation characteristics are liable to deteriorate at the second and third harmonies (broken line in FIG. 10). By contrast, in the present embodiment, it can be seen that attenuation characteristics outside the band are better (solid line in FIG. 10). This has the advantageous effect of attenuating unnecessary waves outside the waveband, thereby improving the electrical characteristics of the mobile communications device.

According to the present invention, since the ferrite and the permanent magnet are both square, there is the advantage that an optimum magnetic field can be applied to the ferrite, improving the electrical properties.

What is claimed is:

1. A nonreciprocal circuit device, comprising a plurality of central electrodes provided on a ferrite, to which a permanent magnet applies a direct current magnetic field, ports of said central electrodes being connected to capacitors for matching; wherein said capacitors for matching comprise single plate capacitors, formed by providing electrodes on both main surfaces of a dielectric substrate such that said electrodes completely cover said main surfaces and oppose each other with said dielectric substrate disposed therebetween; and said capacitors are arranged around said ferrite with electrodes of said single plate capacitors facing corresponding portions of said ferrite.

2. The nonreciprocal circuit device according to claim 1, wherein at least a portion of said electrodes at ground ends of said single plate capacitors face the ferrite.

3. The nonreciprocal circuit device according to claim 1, wherein at least a portion of said electrodes at port ends of said single plate capacitors face the ferrite.

4. The nonreciprocal circuit device according to any one of claims 1–3, wherein said ferrite is rectangular and said single capacitors are arranged around said ferrite.

5. The nonreciprocal circuit device according to claim 4, wherein said permanent magnet is rectangular.

6. The nonreciprocal circuit device according to any one of claims 1–3, wherein said electrodes of said capacitors face an edge of said ferrite and are arranged at an angle of 90 degrees with respect to a major surface of said ferrite.

7. The nonreciprocal circuit device according to any one of claims 1–3, wherein said ferrite is circular and said single plate capacitors are arranged around said ferrite.

8. The nonreciprocal circuit device according to any one of claims 1–3, wherein said permanent magnet is rectangular.

9. A nonreciprocal circuit element comprising, a ferrite;

a permanent magnet applying a direct current magnetic field to said ferrit;

a plurality of central electrodes disposed on said ferrite, having respective ports; and a plurality of matching capacitors each having capacitor electrodes formed on both surfaces of a dielectric substrate such that said capacitor electrodes completely cover said surfaces and are opposed to each other so as to sandwhich said dielectric substrate, wherein said ferrite has a rectangular shape and a capacitor electrodes of said matching capacitors are inclined so as to face said ferrite and said matching capacitors are arranged said ferrite.

10. The nonreciprocal circuit device according to claim 9, wherein said electrodes of said capacitors face an edge of said ferrite and are arranged at an angle of 90 degrees with respect to a major surface of said ferrite.

11. The nonreciprocal circuit device according to claim 9, wherein the permanent magnet is rectangular.

12. A nonreciprocal circuit device, comprising a plurality of central electrodes having respective ports, provided on a ferrite, to which a permanent magnet applies a direct current magnetic filed, said ports of the central electrodes being connected respectively to capacitors for matching, wherein the capacitors for matching are single plate capacitors, comprising electrodes provided on both main surfaces of a dielectric substrate such that said electrodes completely cover the main surfaces and oppose each other with the dielectric substrate disposed therebetween, the ferrite is rectangular, and the single plate capacitors are arranged around the ferrite.

13. The nonreciprocal circuit device according to claim 7, wherein the single plate capacitors are rectangular and extend along the sides of the ferrite.

14. The nonreciprocal circuit device according to any one of claims 12 and 13, wherein the permanent magnet is rectangular.

15. A nonreciprocal circuit element comprising, a ferrite;

a permanent magnet applying a direct current magnetic field to said ferrite;

a plurality of central electrodes disposed on said ferrite, having respective ports, and a plurality of matching capacitors each having capacitor electrodes formed on both surfaces of a dielectric substrate such that said capacitor electrodes completely cover said surfaces and are opposed to each other so as to sandwhich said dielectric substrate, wherein said ferrite has a circular shape and said capacitor electrodes of said matching capacitors are inclined so as to face ferrite and said matching capacitors are arranged around said ferrite.

16. The nonreciprocal circuit device according to claim 15, wherein said electrodes of said capacitors face an edge of said ferrite and are arranged at an angle of substantially 90 degrees with respect to a major surface of said ferrite.

17. The nonreciprocal circuit device according to claim 15, wherein the permanent magnet is rectangular.

18. A nonreciprocal circuit device, comprising a plurality of central electrodes provided on a ferrite, to which a permanent magnet applies a direct current magnetic field, said central electrodes having respective ports; further comprising a matching capacitor connected to one of said ports, said matching capacitor comprising a single plate capacitor, formed by providing electrodes on both main surfaces of a dielectric substrate such that said electrodes completely cover said main surfaces and oppose each other with said dielectric substrate disposed therebetween; and said matching capacitor is arranged with an electrode of said single plate capacitor facing a corresponding portion of said ferrite.

19. The nonreciprocal circuit device according to claim 18, wherein said ferrite is rectangular.

20. The nonreciprocal circuit device according to claim 19, wherein said permanent magnet is rectangular.

21. The nonreciprocal circuit device according to claim 18, wherein said ferrite is circular.

22. The nonreciprocal circuit device according to claim 21, wherein said permanent magnet is rectangular.

* * * * *